United States Patent [19]

Otani

[11] Patent Number: 4,728,939

[45] Date of Patent: Mar. 1, 1988

[54] STEERING WHEEL STEERING AID

[76] Inventor: Tony U. Otani, 6124 Candor, Lakewood, Calif. 90713

[21] Appl. No.: 8,294

[22] Filed: Jan. 29, 1987

[51] Int. Cl.[4] ..... G08B 21/00

[52] U.S. Cl. ..... 340/576; 74/515 R; 180/272; 180/316; 200/52 R; 200/DIG. 2; 340/575

[58] Field of Search ..... 340/576, 575, 665; 200/52 R, DIG. 2; 2/1; 280/771; 180/316, 313, 272; 74/515 R, 552

[56] References Cited

U.S. PATENT DOCUMENTS 3,409,101 11/1968 Williams ..... 340/575
4,617,559 10/1986 Slansky ..... 340/576

*Primary Examiner*—Glen R. Swann, III
*Attorney, Agent, or Firm*—Peter D. Keefe

[57] ABSTRACT

An aid to steering of a vehicle having directional control defined by rotation of a steering wheel consists of a wedge shaped member strapped to an operator's thigh, having a pliable, frictional surface material for mating with the outside rim of the steering wheel. An alternative embodiment provides for a sleep alarm to sound when biasing between the invention and the steering wheel slackens.

10 Claims, 6 Drawing Figures

STEERING WHEEL STEERING AID

BACKGROUND OF THE INVENTION

The invention relates to sterring wheel steering aids, particularly to a steering wheel aid that provides for user contact with the wheel at three simultaneous locations.

Vehicles generally are steered by means of an operator controlled wheel, the steering wheel, which is in turn coupled to the wheel or wheels of the vehicle that are used in turning. Common practice is to utilize both hands on the steering wheel in order to assure the directional path of the vehicle remains true to a desired course. While in theory this is what is desired, in practice this is very infrequently the case. Operators of motorized vehicles, especially passenger car drivers, are often lax in their effort at maintaining a continuously firm grip on the steering wheel while they drive. Modern expressway driving, which often includes cross-country trips, tends to tire many drivers, adding greatly to their deviation from the safe standards of steering wheel discipline.

Safety of the motor vehicle operator and his or her passengers can be greatly improved if an auxiliary point of contact between the steering wheel and the operator is provided. By lessening the demand for continuous two-handed operation of the vehicle, the trip becomes safer and the operator is able to utilize his hands more freely and compentently in furthering his duties as vehicle operator, which involves more than steering alone.

Safety can be greatly increased for motor vehicle operators who are subject to long periods of driving by including, in a steering wheel steering aid that affords an auxiliary point of contact, an alarm that will sound if the operator should loosen his or her conscious biasing of the steering wheel steering aid against the steering wheel, as would happen in the event sleep overtook him or her.

Finally, many small motor vehicles develop mechanical vibration in the steering column when speeds approach those commonly used on interstate highways. An auxiliary point of contact between the driver and the steering wheel which is able to readily absorb these tiring vibrations is needed.

It is, therefore, an object of the invention to provide an auxiliary point of contact between the operator of a motor vehicle and the steering wheel that is easy to use, reduces vibration felt by the driver, helps to free the driver's hands for other vehicular operations, and is removable, portable, simple and inexpensive.

It is another object of the invention to provide a steering wheel assist that includes an alarm that will sound should the operator's muscles go lax as in the event the person falls asleep.

These and additional objects, advantages, features, and benefits of the invention will become apparent from the following specification.

SUMMARY OF THE INVENTION

The invention is a steering wheel steering aid for an operator of a vehicle that employs a steering wheel for directional guidance, whereby, in addition to the operator's two hands, a third point of contact with the steering wheel is achieved by means of a structure attached to the operator's thigh.

The invention consists of a main body, from the lower section of which depend straps that hold the invention onto the operator's thigh, while the upper section of which is covered with a pliable, frictional material designed to contact the rim of a steering wheel. In an alternative embodiment, a sleep alarm is included that will sound when an internally powered sensor picks-up pressure relaxation between the main body of the invention and the steering wheel, as would happen when the driver begins to fall asleep.

DETAILED DESCRIPTION OF THE PREFERRED EMBODIMENT

Figure 1:
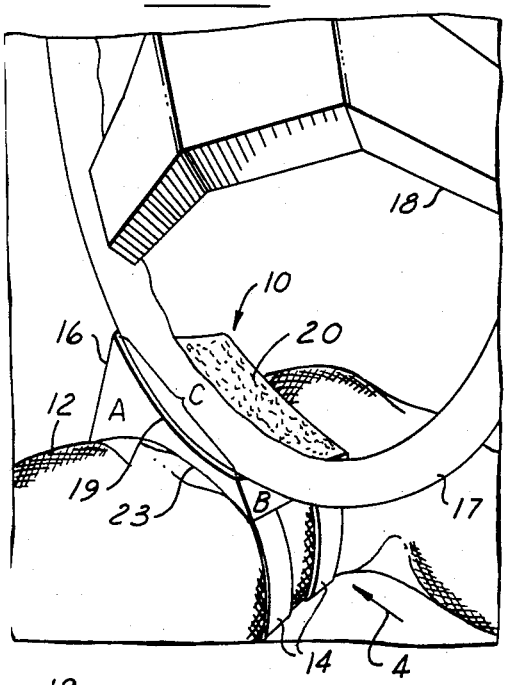
FIG. 1 is a perspective view of the invention in operations.

Referring now to the drawings, FIG. 1 shows the invention being used by an operator of a motor vehicle to assist him or her in steering. The invention is designed to act as a third point of contact between the steering wheel and the operator of the vehicle, as an aid to safety, comfort and vehicular operations other than steering; it is not intended to be a substitute for hand controlled steering. By means of the invention, one hand may be freed to more effectively deal with operations of the vehicle, and indeed, momentarily both hands might be so freed; but, the invention does not give license to the operator to freely use his or her hands obliviously to the first and foremost task at hand, which is steering the vehicle.

In FIG. 1, the invention 10 is strapped to an operator's thigh 12, in this case the left one, by means of attachment straps 14. The thigh selected is generally up to the user, but preferably the leg that is used for clutch would be selected, since the right leg is constantly occupied with brake and accelerator functions. It will be noticed from the figure that the main body 16 of the invention is generally wedge shaped, having a greater height at side A than at side B. This is designed so that the user can very easily engage and disengage operation of the invention with the steering wheel by a simple rotary movement of his or her thigh, while at the same time providing a curved upper surface to assure a maximum of contact length C with the outside rim 17 of the steering wheel 18. Additionally, it will be further noticed from the figure that the main body is also tapered from the point of steering wheel contact towards the user's knee; this particularly shown in FIG. 4, where the height of the main body 16 is greater at end D than at end E. The reason for a tapering in the main body is so allow for adjustment of the invention to a location on the user's thigh that allows for comfortable contact between the user's thigh and the steering wheel for various thigh sizes among potential user's and the thigh to steering wheel distance that may be encountered in different makes of vehicles. In FIG. 1, the invention is shown positioned on the user's thigh at a location that allows for comfortable mating with the particular vehicle's steering wheel, in this case close to end D in FIG. 4.

The foregoing recited objectives of the invention are accomplished by constructing the main body 16 of the invention into upper, central, and lower sections, as follows.

Figure 2:
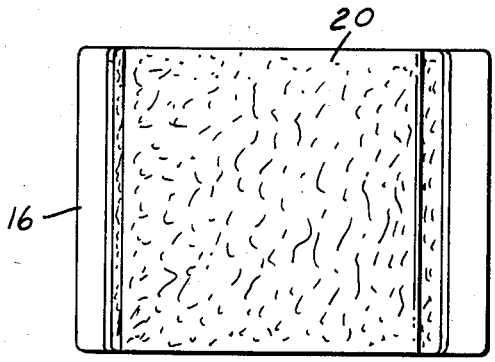
FIG. 2 is a plan view of the invention.
Figure 3:
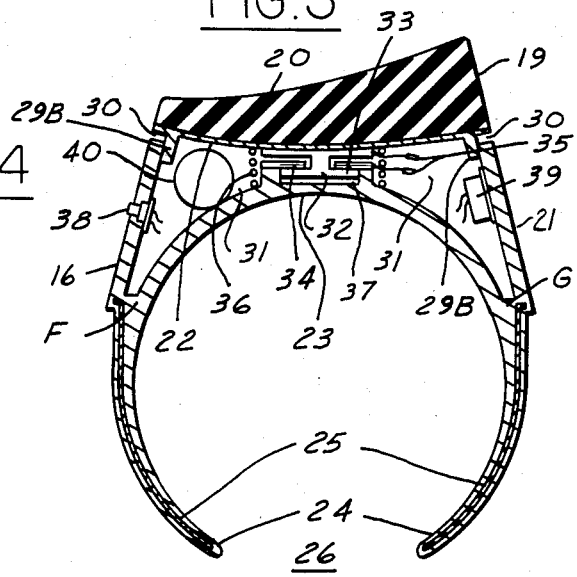
FIG. 3 is a front view of the invention, along lines 3—3 in FIG. 4, showing internal alarm components.
Figure 4:
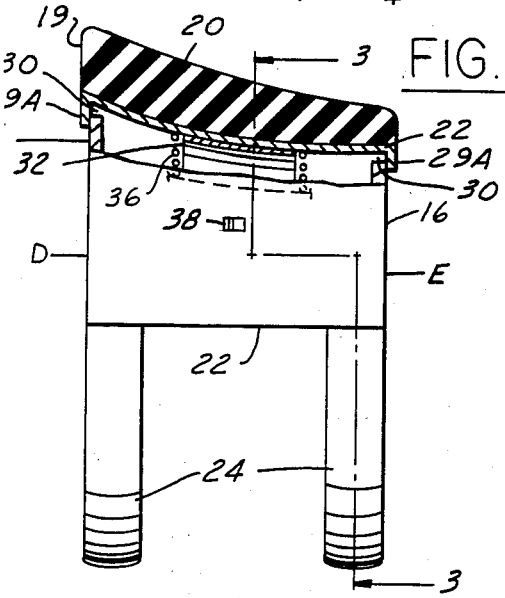
FIG. 4 is a side view of the invention, along line 4 in FIG. 1.
Figure 5:
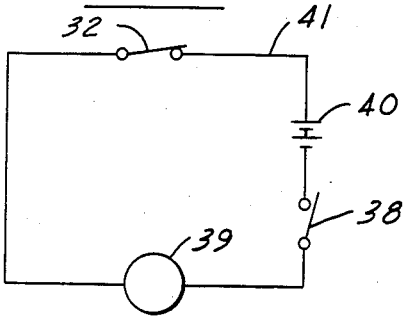
FIG. 5 is an electrical circuit schematic for the alarm.

In the preferred embodiment shown in FIGS. 1 and 2, the upper section 19 of the main body 16 is made from a soft, pliable, frictional material 20, such as urethane rubber. This ensures that the steering wheel is adequately gripped by the invention when the user rotates his or her thigh to engage it. FIG. 2 more particularly shows the invention from the top, where it can be seen that the surface material covers the entire top surface of the main body. FIGS. 3, 4, and 5, show that the shape of upper section 19 of the main body 16 is determined by the thickness of the surface material 20, by which is achieved both the wedge shape and the tapering of the main body necessary for proper operation of the invention.

Figure 6:
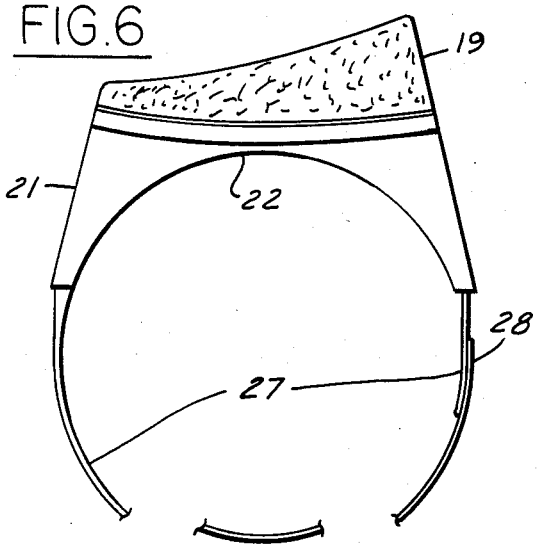
FIG. 6 is a front view of an alternative embodiment of the invention using a wrap around strap.

In the preferred embodiment shown in FIGS. 3, 4, and 6, the central section 21 of the main body is made of a rigid material, such as plastic, forming a base on which is attached the upper section 19. Alternatively, it is possible to construct the invention main body to include an upper covering that forms the generally wedge and tapering shapes of the upper section 19, with the surface material 20 being applied with uniform thickness thereto. Such a covering would be generally fashioned from the upper section affixing base 22, shown in FIGS. 3 and 4.

In the preferred embodiment shown in FIG. 3, it will be seen that the main body 16 has a lower section 23 which mates with the central section 21 at points F and G, and is curved to fit a user's thigh. Depending therefrom are a set of attachment straps 14. A front and rear strap is provided to ensure that the invention is securely attached to the thigh and that the gripping action of the surface material will function without slipping on the user's leg independent of where the invention is positioned in relation to the user's thigh and the steering wheel. FIGS. 3 and 6 show alternative means to hold the invention to the operator's thigh. In FIG. 3, the straps 24 are made of spring material, or may include internally a spring material 25, while a substantial gap 26 is provided between them. The operator merely inserts his or her thigh through the gap by gentle spreading of the straps. Upon releasing, the spring action of the straps provides sufficient biasing to hold the invention securely. This embodiment is particularly attractive for female users who may be wearing a skirt. In FIG. 6, the straps 27 are designed to continuously encircle the thigh, meeting at a location on the inside of the leg, where a commercially available fastener 28, such as a buckle, snap, or VELCRO, is used to attach them.

FIGS. 3, 4 and 5 are directed to an alternative embodiment of the invention incorporating a sleep alarm that detects slackened pressure of the main body 16 against the outside rim 17 of the steering wheel 18. As mentioned above, the purpose of this feature of the invention is to act as an early warning that the driver is beginning to fall asleep while operating the vehicle. The basic theory of operation is that it requires an awake mind to retain biasing action of the invention against the steering wheel and one of the first signs of a person falling asleep is substantial reduction in muscle tension; hence, as an operator falls asleep, reduced muscle tension should cause a sufficient reduction in the biasing of the main body of the invention against the steering wheel to sound an alarm.

In FIG. 3 a front view of the invention is provided which shows a cavity 31 in the central section 21 of the main body 16 for containing the internally located components of the alarm system. In this embodiment, the upper section 19 is slidably connected to the central section 21 of the main body 16; the sliding action is intended to be responsive to biasing of the invention against the steering wheel. This is achieved by utilizing an affixing base 22 which attaches to the side of the surface material 20 that faces the central section of the main body and which acts to guide the sliding action of the upper section relative to the central section by means of cooperative action between lips 29A and 29B and the walls of the central section 21. A gap 30 is provided between the central section walls and the affixing base so that the upper section can move in relation to the central section. A normally electrically closed, or "on", sensor switch 32 is located in the cavity 31 at the mid-point inside the central section 21 of the main body 16, between the lower section 23 and the upper section affixing base 22. As can be seen by reference to FIG. 3, the sensor switch is made of two components, one 33 attached to the affixing base 22, and one 34 attached to the lower section 23. Normally, these metallic components of the switch are in contact, and, accordingly, leads 35 have a closed electrical circuit between them. In order to cause the switch components 33 and 34 to be in normal contact, a spring 36 biases the upper section away from the lower section of the main body 16. Separation is limited by contact between the switch components. When the upper section contacts the steering wheel, it is pressed toward the lower section of the main body, causing the switch components 33 and 34 to separate, thereby breaking electrical contact. Depression of the upper section toward the lower section of the main body is limited by switch component 33 making contact with the lower section of the main body at 37. Thus, the electrical status of the sensor switch, either electrically "on" or "off", is responsive to biasing of the upper section against the rim of the steering wheel. Additional components that compose the alarm circuit are a control switch 38 to activate and deactivate the alarm system, a sonic device 39 to sound the alarm, such as a speaker or buzzer, and a source of electrical power, here shown as a replaceable battery pack 40, but which could be the vehicle's electrical power system. FIG. 5 particularly discloses an electrical circuit to carry out the alarm function using the aforementioned components and connecting wiring 41.

In operation, the operator of the vehicle would seat himself or herself into the driver's seat in the usual manner. The user would then attach the invention to the thigh on the leg not used for braking, by means of wrapping the straps around the thigh and then fastening them, or, alternatively, spreading the straps in the event a spring biased embodiment is employed. Careful attention should be made to attach the invention at a location on the thigh that will very easily and naturally allow for the invention to contact with the outer rim of the steering wheel by a simple movement of the thigh.

The operator would then drive normally, and in situations of extended substantially straight path driving would, as desired, rotate his or her thigh slightly to cause engagement of the surface material 20 of the upper section 19 of the main body 16 of the invention 10 to frictionally grab the outer rim 17 of the steering wheel 18. Disengagement, for turning or other vehicularly related activity, is simply and quickly accomplished by moving the thigh oppositely to the manner used to engage the invention.

It should be noted in this regard that should an untoward incident develop in the course of driving, and the operator to some extent panic, putting greater, rather than lesser biasing of the invention on the steering wheel, the frictional coefficient between the outer rim 17 of the steering wheel and the surface material 20 of the invention should be such as to not unreasonably interfere with conventional hand based steering. Thus, while the invention does provide a third point of contact between the driver and the steering wheel, the primary, and overriding points of contact remain the hands.

To engage the sleep alarm system, the invention must first be in an active mode of operation, that is, it must be biasing against the steering wheel. Biasing against the steering wheel causes the sensor switch 32 to be switched to the electrically non-conducting, or "off" position. Thus, the control switch 38 must be in the "off" position until biasing of the invention against the outside rim of the steering wheel is effected, or else the alarm will sound, since the sensor switch is normally "on". When biasing is present, the control switch may be activated and no alarm will sound unless leg tension, which supplies the biasing of the invention against the steering wheel, is slackened as would happen if sleepiness came upon the operator. Ordinarily, the user would deactivate the control switch before discontinuing use the invention.

While the preferred embodiment uses a main body which is tapered, wedge shaped, and curved to mate with the rim of a steering wheel, it is possible to design a main body which does not incorporate these particular and preferred features. Possible exemplary variations may use a main body having a rounded or flat upper section.

From the foregoing description, it will become clear that this invention may be used in any devices which utilize a steering wheel for directional control. While it has great practical use in passenger automobiles, it is adaptable for use in trucks, buses, tractors, boats, planes and a host of other steering wheel directed conveyances.

To those skilled in the art to which this invention appertains, the above described preferred embodiment may be subject to change or modification. Such changes or modifications can be carried out without departing from the scope of the invention, which is intended to be limited only by the scope of the appended claims.

What is claimed is:

1. An aid to steering of a vehicle having directional control defined by rotation of a steering wheel, comprising:

a main body having a lower section curved for fitting over a thigh of a driver seated in said vehicle and an upper section having a pliable, frictional surface for mating with a conventional steering wheel rim of said vehicle, said main body being sized to allow said rim mating to occur as desired by said driver when said lower section is attached to said thigh; and means for attaching said lower section to said thigh.

2. The invention of claim 1, including a sleep alarm, comprising:

a sensor switch located on said main body for sensing biasing of said upper section against said steering wheel rim, having an electrical status responsive to said biasing;

a control switch to activate the sleep alarm;

a sonic device to sound said alarm in response to the electrical status of said sensor switch;

an electrical circuit for electrically connecting said switches and said sonic device; and means for connecting said electrical circuit to a source of electrical power.

3. The invention of claim 1, wherein said means for attaching comprises at least one set of straps which depend from said lower section and are long enough to encircle said driver's thigh, each of which being releasably connected together.

4. The invention of claim 1, wherein said means for attaching comprises at least one set of spring biased straps which depend from said lower section having a gap therebetween so as to allow insertion of said driver's thigh and thereupon clamp on to said thigh by action of said spring biasing.

5. The invention of claim 1, wherein said pliable, frictional surface is urethane rubber.

6. An aid to steering of a vehicle having directional control defined by rotation of a steering wheel, comprising:

a wedge shaped and tapered main body having a lower section curved for fitting over a thigh of a driver seated in said vehicle and an upper section having a pliable, frictional surface curved for mating with a conventional steering wheel rim of said vehicle, said main body being sized to allow said rim mating to occur as desired by said driver when said lower section is attached to said thigh; and means for attaching said lower section to said thigh.

7. The invention of claim 6, including a sleep alarm, comprising:

a sensor switch located between said upper section and said lower section for sensing biasing of said upper section against said steering wheel rim, having an electrical status responsive to said biasing;

a control switch attached to said main body for activating the sleep alarm;

a sonic device attached to said main body for sounding said alarm in response to the electrical status of said sensor switch;

an electrical circuit for electrically connecting said switches and said sonic device; and means for connecting said electrical circuit to a source of electrical power.

8. The invention of claim 6, wherein said means for attaching comprises at least one set of straps which depend from said lower section and are long enough to encircle said driver's thigh, each of which being releasably connected together.

9. The invention of claim 6, wherein said means for attaching comprises at least one set of spring biased straps which depend from said lower section having a gap therebetween so as to allow insertion of said driver's thigh and thereupon clamp on to said thigh by action of said spring biasing.

10. Method for steering of a vehicle having directional control defined by rotation of a steering wheel, comprising:

providing a means for a third contact point between a driver and the steering wheel using said driver's thigh; and steering said vehicle using at least one hand on said wheel while simultaneously rotating said thigh until said third contact point means biases against said steering wheel.

* * * * *